US010415383B2

(12) United States Patent
Ebner

(10) Patent No.: US 10,415,383 B2
(45) Date of Patent: Sep. 17, 2019

(54) CUTTER ASSEMBLY WITH ROLLING ELEMENTS AND METHOD OF DISASSEMBLING

(71) Applicant: SANDVIK INTELLECTUAL PROPERTY AB, Sandviken (SE)

(72) Inventor: Bernhard Ebner, Knittlfeld (AT)

(73) Assignee: Sandvik Intellectual Property AB, Sandviken (SE)

( * ) Notice: Subject to any disclaimer, the term of this patent is extended or adjusted under 35 U.S.C. 154(b) by 13 days.

(21) Appl. No.: 15/738,229

(22) PCT Filed: Jun. 22, 2015

(86) PCT No.: PCT/EP2015/063958

§ 371 (c)(1),
(2) Date: Dec. 20, 2017

(87) PCT Pub. No.: WO2016/206710

PCT Pub. Date: Dec. 29, 2016

(65) Prior Publication Data

US 2018/0171793 A1 Jun. 21, 2018

(51) Int. Cl.

| | |
|---|---|
| ***E21D 9/11*** | (2006.01) |
| ***E21C 25/16*** | (2006.01) |
| ***E21D 9/10*** | (2006.01) |
| ***E21B 10/22*** | (2006.01) |

(52) U.S. Cl.

CPC ..... *E21C 25/16* (2013.01); *E21B 10/22* (2013.01); *E21D 9/1013* (2013.01); *E21D 9/11* (2013.01)

(58) Field of Classification Search

CPC ..... E21B 10/22; E21D 9/11; E21D 9/1013
See application file for complete search history.

(56) References Cited

U.S. PATENT DOCUMENTS

| | | | | |
|---|---|---|---|---|
| 2,126,034 A | | 8/1938 | Reed | |
| 2,336,337 A | * | 12/1943 | Zublin | E21B 10/083 175/348 |
| 5,064,007 A | | 11/1991 | Kaalstad | |
| 7,182,407 B1 | | 2/2007 | Peach | |

(Continued)

FOREIGN PATENT DOCUMENTS

| | | | |
|---|---|---|---|
| RU | 2290509 | C2 | 12/2006 |
| SU | 907262 | A1 | 2/1982 |
| WO | 02/066793 | A1 | 8/2002 |

*Primary Examiner* — Sunil Singh
(74) *Attorney, Agent, or Firm* — Corinne R. Gorski

(57) ABSTRACT

The present disclosure relates to a cutter assembly for an undercutting machine for cutting a rock workface and a method of disassembling a cutter assembly. The cutter assembly includes a shaft supporting structure, a shaft at least partly arranged within the shaft supporting structure, a cutter device arranged on the shaft or the shaft supporting structure, a first rolling element arranged between the shaft supporting structure and the shaft in a floating or slidable manner in an axial direction, and a second rolling element arranged between the shaft supporting structure and the shaft. A line orthogonal to an outer surface of the second rolling element crosses the longitudinal axis of the shaft at a center plane of the first rolling element or within a range of +/−25% of an axial extension of the first rolling element from the center plane.

13 Claims, 4 Drawing Sheets

(56) References Cited

U.S. PATENT DOCUMENTS

| | | | | |
|---|---|---|---|---|
| 2002/0093239 | A1* | 7/2002 | Sugden | E21C 25/16<br>299/71 |
| 2009/0058172 | A1 | 3/2009 | De Andrade et al. | |
| 2012/0145465 | A1* | 6/2012 | Dobrolyubov | E21B 10/086<br>175/428 |

* cited by examiner

CUTTER ASSEMBLY WITH ROLLING ELEMENTS AND METHOD OF DISASSEMBLING

RELATED APPLICATION DATA

This application is a § 371 National Stage Application of PCT International Application No. PCT/EP2015/063958 filed Jun. 22, 2015.

FIELD OF INVENTION

The present invention relates to a cutter assembly for an undercutting machine for cutting a rock workface comprising a shaft supporting structure; a shaft at least partly arranged within the shaft supporting structure; and a cutter device arranged on the shaft on the shaft supporting structure. The invention further relates to a method of disassembling a cutter assembly for an undercutting machine for cutting a rock workface.

BACKGROUND ART

Tools and tool heads for mining of rock material or rock boring devices are known, for example, from U.S. Pat. No. 7,182,407 B1 or WO 02/066793 A1. However, during work excavation, high forces act on the rotating cutter device, which have to be accommodated by an appropriated bearing arrangement. Due to the high forces occurring in the field of application, the life span of the bearing arrangement is typically limited.

SUMMARY OF THE INVENTION

It is an object of the present invention to provide a cutter assembly for an undercutting machine for cutting a rock workface and a method of disassembling a cutter assembly for an undercutting machine for cutting a rock workface, which eliminate or reduce at least one of the above mentioned drawbacks of existing solutions. In particular, it is an object of the present invention to provide a cutter assembly for an undercutting machine for cutting a rock workface and a method of disassembling a cutter assembly for an undercutting machine for cutting a rock workface, which improve the life span of the bearing assembly of the shaft or the shaft supporting structure and/or provide for an efficient bearing assembly of the shaft or the shaft supporting structure.

According to a first aspect, the object is solved by a cutter assembly for an undercutting machine for cutting a rock workface comprising: a shaft supporting structure; a shaft at least partly arranged within the shaft supporting structure; a cutter device arranged on the shaft or the shaft supporting structure; and a first rolling element arranged between the shaft supporting structure and the shaft in floating or slidable manner in axial direction; a second rolling element arranged between the shaft supporting structure and the shaft, wherein a line orthogonal to an outer surface of the second rolling element crosses the longitudinal axis of the shaft at a centre plane of the first rolling element or within a range of +/−25% of an axial extension of the first rolling element from said centre plane.

In particular, it is preferred that a line orthogonal to an outer surface of a second roller of the second rolling element crosses the longitudinal axis of the shaft at a centre plane of the first rolling element or within a range of +/−25% of an axial extension of the first rolling element from said centre plane.

The cutter assembly for an undercutting machine for cutting a rock workface has a shaft supporting structure and a shaft at least partly arranged within the shaft supporting structure. For example, the shaft supporting structure may be a housing surrounding the shaft at least partly. Further, the cutter assembly comprises a cutter device, which may be arranged on the shaft or a shaft supporting structure. The cutter device preferably is arranged coaxial with the shaft or the shaft supporting structure. The shaft typically has a longitudinal extension and a longitudinal axis. The cutter device may have the form of a cutter ring, a cutter disc or any other form of a cutter element suitable for being arranged on the shaft or the shaft supporting structure as described herein for cutting a rock workface in an undercutting machine.

Preferably, the cutter device is connected rotationally rigid in the sense of a torsion proof connection to the shaft or the shaft supporting structure, such that a rotation of the shaft or the shaft supporting structure, respectively, leads to a corresponding rotation of the cutter device to perform the cutting operation. Further preferably, the connection between the cutter device with the shaft or the shaft supporting structure is a releasable connection, which allows removing the cutter device for an exchange for a new one or an overhauled one.

The cutter assembly further comprises two rolling elements arranged between the shaft supporting structure and the shaft. The first rolling element is arranged in a floating or slidable manner in an axial direction. In this way, it is ensured that the first rolling element substantially does not take loads in the axial direction.

The second rolling element is arranged such that a (virtual) line orthogonal to an outer surface of this second rolling element, preferably of a second roller of this second rolling element, crosses the axial direction of the shaft of the cutter assembly at a centre plane of the first rolling element or within a range of +/−25% of an axial extension of the first rolling element from that centre plane. The centre plane of the first rolling element is understood to be a plane orthogonal to the axial direction of the shaft, which bisects the first rolling element in its axial extension. In other words, the inclination or curvature or a tangent of the outer surface of the second rolling element, preferably of a second roller of this second rolling element, is such that a line orthogonal to this outer surface crosses the axial direction of the shaft at some point, in particular when considering a longitudinal cross section along the axis of the shaft. The second rolling element is now arranged such that this point where the line crosses the axial direction lies at the centre plane of the first rolling element or closely before or behind it as defined by the range of +/−25% of the axial extension of the first rolling element from that centre plane. Preferably, this range is +/−20%, +/−15%, +/−10%, +/−7.5%, +/−5%, +/−2.5%, or +/−1% of the axial extension of the first rolling element.

The first and/or second rolling elements preferably are designed as rotational symmetric elements arranged coaxial to the shaft and further arranged in a circumferential manner. The first and/or second rolling elements preferably each comprise a number of first or second rollers, respectively, arranged equidistant in a circumferential manner.

The cutter assembly with the first and second rolling elements as described herein has the advantage that the first rolling element substantially does not take loads in an axial direction, whereas the second rolling element does. Therefore, the first rolling element can be designed and dimensioned efficiently to take primarily radial loads. A clear load case ensures that the first rolling element can be efficiently and reliably dimensioned to the loads occurring during normal operation of the cutter assembly and therefore the life span of the first rolling element can be enhanced.

The positioning of the second rolling element as described herein reduces the amount of radial loads acting on the second rolling element. By designing a bearing assembly for a cutter assembly with the first rolling element and the second rolling element arranged as described herein, also for the second rolling element the load case can be defined more clearly as in existing solutions and thus the life span also of the second rolling element can be enhanced. Further, more clearly defining the load cases for the first and second rolling elements allows for a more efficient design of these rolling elements such that an extended life span of the first and second rolling elements can be achieved at lower cost and/or reduced installation space.

Further, the cutter assembly with the first and second rolling elements has the advantage, that disassembling of the cutter assembly, like servicing, in particular inspection, maintenance, exchange and/or repair tasks on the cutter assembly or parts thereof, in particular of the sealing arrangement and/or the sealing carrier, and/or the removal of the cutter device and/or a rear cover arranged on the shaft and/or the shaft supporting structure, can be performed while the first and second rolling elements (and preferably also a third rolling element) remain installed in their positions between the shaft supporting structure and the shaft. In other words, the bearing assembly with the first and second rolling elements (and possibly a third rolling element) can remain installed and in place while the cutter device, and/or a rear cover and/or a sealing carrier and/or a sealing arrangement may be disassembled, exchanged, removed, or the like.

In a particularly preferred embodiment, the cutter device is detachably but rotationally rigid mounted on said shaft, and the shaft supporting structure is fixed. Preferably, the shaft supporting structure is fixed relative to a main body of a cutter module, the cutter module may comprise at least one cutter assembly as described herein. Further preferably, the shaft can be rotationally driven by a rotary drive of the cutter assembly, wherein a torque can be transferred from the rotary drive via the shaft to the cutter device to perform the cutting operation. In particular, it can be preferred that the connection between the cutter device and the shaft is realized via a locking arrangement as described further below.

According to a further preferred embodiment, the second rolling element is arranged further distant from the cutter device in an axial direction of the shaft than the first rolling element.

Further preferably, the cutter device is a cantilevered cutter ring. The cantilevered cutter ring preferably has an outer radial end and an inner radial end and further preferably an outer axial end face adjacent the outer radial end and an inner axial end face or inner axial contact face adjacent the inner radial end, wherein the outer axial end face and the inner axial end face preferably are parallel to each other. The diameter of the outer radial end preferably is larger than the diameter of the inner radial end.

According to a further preferred embodiment, a third rolling element is arranged between the shaft supporting structure and the shaft. It is particularly preferred that (while the first rolling element is designed to take substantially radial loads, and the second rolling element is designed to substantially take axial loads resulting from cutting operation, which can also be referred to as pushing forces) the third rolling element is adapted and arranged to substantially transfer loads in an axial direction, which can be referred to as pushing forces, i.e. axial loads in an opposite direction the second rolling element is primarily designed for. Further preferably, the third rolling element is adapted and arranged to bias or apply a pretension to the second rolling element.

An advantage is that for all three rolling elements, clear load cases are defined and all three loading elements can be designed and dimensioned for their primary load transfer directions, which allows for an enhanced life span, possibly at reduced cost and/or reduced installation space.

In a preferred embodiment, the third rolling element is arranged further distant from the cutter device in an axial direction of the shaft than the first rolling element and the second rolling element.

Preferably, also the third rolling element is designed as rotational symmetric element arranged coaxial to the shaft and further arranged in a circumferential manner. The third rolling element preferably comprises a number of third rollers arranged equidistant in a circumferential manner.

According to a further preferred embodiment, the third rolling element and the second rolling element are adapted and arranged such that an inclination direction of a contact angle and/or rotation axes of the second rolling element, preferably of second rollers of the second rolling element, is different from an inclination direction of a contact angle and/or rotation axes of the third rolling element, preferably of third rollers of the third rolling element. In this embodiment, the arrangement of the second and third rolling elements is such that a load separation of axial forces in opposite direction (pulling and pushing forces) between the second and third rolling elements is facilitated or supported.

In a further preferred embodiment, a centre of a sphere formed by outer surfaces of the second rolling element, preferably of second rollers of the second rolling element, lies within the centre plane of the first rolling element or within a range of +/−25% of an axial extension of the first rolling element from said centre plane. In this embodiment, the outer surfaces of the second rolling element, preferably of second rollers of the second rolling element, form a segment of a sphere such that a (virtual) centre of lies within the centre plane of the first rolling element or within the range along its axial extension as mentioned above.

It is particularly preferred that the second rolling element is a spherical thrust bearing. Further it is particularly preferred that the first rolling element is a spherical or toroidal roller bearing. Further preferably, the third rolling element is a tapered roller bearing.

According to a further aspect, the object is solved by a cutter module comprising two or more cutter assemblies as described herein.

According to a further aspect, the object is solved by a method of disassembling a cutter assembly for an undercutting machine for cutting a rock workface, preferably a cutter assembly as described herein, the method comprising: providing a cutter assembly for an undercutting machine for cutting a rock workface, preferably a cutter assembly as described herein, removing the cutter device and/or a rear cover arranged on the shaft and/or the shaft supporting structure; reinstalling the cutter device and/or the rear cover or installing a new cutter device and/or a new rear cover; wherein the first and second rolling elements remain installed in their positions between the shaft supporting structure and the shaft during the disassembling of the cutter assembly.

According to a preferred embodiment of the method, the third rolling element remains installed in its position between the shaft supporting structure and the shaft during the disassembling of the cutter assembly.

Preferably, the disassembling can be carried out to service the cutter assembly. For example, inspection, maintenance, exchange and/or repair tasks may be performed on the cutter assembly or parts thereof, in particular a sealing arrangement and/or sealing carrier, preferably after removing the cutter device and/or a rear cover arranged on the shaft and/or the shaft supporting structure and before reinstalling the cutter device and/or the rear cover or installing a new cutter device and/or a new rear cover.

As to the advantages, preferred embodiments and details of the method and its preferred embodiments, reference is made to the corresponding aspects and embodiments described above with respect to the cutter assembly.

It is further particularly preferred that the aspects and embodiments of the cutter assembly described above are employed in a cutter assembly and its aspects and embodiments as described in the following or realized in combination with aspects or embodiments of a cutter assembly as described in the following.

According to a first preferred combinable aspect, the cutter assembly for an undercutting machine for cutting a rock workface, can comprise a shaft mountable on the machine with one end extending from the machine, and a cutter device arranged in connection to the extended end of the shaft, wherein the cutter device is connected releasably and rotationally rigid to the shaft with a locking arrangement, wherein the locking arrangement comprises a first locking device arranged and adapted to transfer substantially axial loads, and a second locking device arranged and adapted to transfer substantially radial loads.

The cutter device of the cutter assembly is connected to the end of the shaft extending from the undercutting machine in a manner which allows the cutter device to be released from the shaft, in order to exchange the cutter device or to temporarily remove it, for overhauling it, for example. In particular, this releasable connection allows removing the cutter device in a substantially non-destructive way. For example, it has been known in the prior art that cutter devices, or at least substantial parts of it, needed to be cut into pieces in a workshop in order to be removed from the shaft, which can be avoided with the cutter assembly as described herein.

Further, the cutter device preferably is connected in a rotationally rigid manner to the extended end of the shaft. A rotationally rigid connection means that a rotation of the shaft also leads to a rotation of the cutter device and vice versa. Such a torsion proof connection is used to transfer torque from the shaft to the cutter device in order to rotate the cutter device to perform the cutting operation.

This preferred releasable and rotationally rigid connection between the cutter device and the shaft is realized by a locking arrangement having a first and a second locking device. The two locking devices are arranged and adapted such that axial loads are transferred primarily via the first locking device and radial loads are transferred primarily via the second locking device. In particular, the first locking device preferably can be arranged and adapted to transfer substantially axial loads in opposite directions. Preferably, the first locking device and/or the second locking device are designed in a substantially ring-shaped or circumferential shape and further preferably surround the shaft of the cutter assembly coaxially.

Preferably, the shaft is mounted on the undercutting machine and connected to a rotary drive adapted and arranged to put the shaft into a rotary motion to transfer a torque to the cutter device for performing a cutting operation on a rock workface. The cutter device preferably is arranged coaxial with the shaft. The shaft typically has a longitudinal extension and a longitudinal axis. The cutter device may have the form of a cutter ring, a cutter disc or any other form of a cutter element suitable for being mounted on the shaft releasably and rotationally rigid with the locking arrangement as described herein for cutting a rock workface in an undercutting machine. The shaft preferably is at least partly arranged within a shaft supporting structure. Further preferably, between the shaft supporting structure and the shaft a first and a second rolling element, and possibly a third rolling element, are provided as described below.

The provision of two locking devices and their arrangement and adaptation to transfer either substantially axial loads (first locking device) or substantially radial loads (second locking device) has several advantages. Firstly, the locking devices can be designed clearly for their primary load transfer direction and thus the life span can be increased while at the same time weight and cost as well as space can be efficiently used and optimized. Further, providing two locking devices allows applying initial and targeting tensions to the two locking devices stepwise and in an alternating manner, as will be described in more detail also with respect to the method of assembling. Thus, by the provision of two locking devices with different primary or substantially load transfer directions, which are preferably substantially orthogonal to each other, the mounting of the cutter device on the shaft can be facilitated and also the removal of the cutter device and the provision of a new or overhauled cutter device and its connection on the shaft is facilitated.

Preferably, the first and second locking devices are radially spaced apart from each other. Further preferably, the first locking device is located radially outwardly from the second locking device. The first and second locking devices may also be axially spaced apart from each other or their axial extension may overlap, at least partly.

In a preferred embodiment, the second locking device is arranged and adapted to centre the cutter device on the shaft and/or the first locking device is arranged and adapted to transfer bending moments. The arrangement and adaptation of the first locking device to transfer bending moments may result, for example, from the arrangement and adaptation of the first locking device to transfer substantially axial loads in opposite directions and the design of the first locking device in a substantial circumferential manner. It is further preferred that the second locking device, which is arranged and adapted to transfer substantially radial loads, also serves to centre the cutter device on the shaft, since the transfer of radial loads and centring the cutter device on the shaft can be efficiently performed via the same locking device.

In a further preferred embodiment, the first locking device comprises one, two or more fastening elements for fastening the cutter device to the shaft. Preferably, a plurality of fastening elements for fastening the cutter device to the shaft are included in the first locking device. The plurality of fastening elements preferably are arranged equidistant in a circumferential manner. The fastening elements may be bolts for engaging mating bores, preferably extending through the cutter device and extending into blind bores in the shaft. Further preferably, the bolts may be threaded bolts for engaging mating threaded bores, preferably extending through the cutter device and mating threaded blind bores in the shaft.

According to a further preferred embodiment, the second locking device comprises a tapered locking assembly, including at least one fixing element for fixing a tapered outer surface and a tapered inner surface relative to each other. A tapered locking assembly is a preferred embodiment of the second locking device suitable for transferring substantially radial loads and for centring the cutter device on the shaft. A tapered locking assembly includes at least one fixing element, preferably two or more fixing elements, for fixing two tapered surfaces relative to each other. Preferably, a plurality of fixing elements for fixing the inner and outer tapered surfaces is provided. The plurality of fixing elements preferably is arranged equidistant in a circumferential manner. Preferably, the fixing elements are bolts, preferably threaded bolts mating corresponding threaded bores.

The tapered outer surface and a tapered inner surface are preferably arranged coaxial to each other, with opposite tapering directions, which means that for one of the tapered surfaces, its diameter increases along the longitudinal axis of the shaft in an opposite direction of the other tapered surface, in which the diameter of other tapered surface increases. The tapered inner and outer surfaces preferably engage each other by a friction fit and/or a form locking fit.

In a preferred embodiment, the tapered locking assembly includes a locking ring, which may be an inner locking ring, comprising the tapered outer surface. The locking ring preferably is an element of the tapered locking assembly, which is removable from the shaft and/or the cutter device and can be arranged with the cutter device on the shaft during assembly.

In a further preferred embodiment, the tapered locking assembly includes a further locking ring, which may be an outer locking ring, comprising the tapered inner surface. Also this further locking ring preferably can be an element of the tapered locking assembly, which is removable from the shaft and/or the cutter device and can be arranged with the cutter device on the shaft during assembly.

In a combination of the previous two embodiments, the tapered locking assembly can include, for example, an inner locking ring comprising the tapered outer surface and an outer locking ring comprising the tapered inner surface. Then the tapered locking assembly includes two locking rings comprising the two tapered surfaces.

Alternatively, it can be preferred that the tapered inner surface is formed on the cutter device. In this embodiment, the tapered locking assembly only includes an inner locking ring comprising the tapered outer surface, while the tapered inner surface of the tapered locking assembly is formed on the cutter device. For example, the cutter device may have an inner, ring-shaped hole, on which the tapered inner surface is realized. In this embodiment, only one inner locking ring as a removable element of the tapered locking assembly needs to be arranged during assembly while the tapered inner surface is coming with the cutter device during arrangement.

As a further possibility, it could be preferred that the tapered outer surface is formed on the shaft. Preferably, this is combined with an embodiment where the tapered locking assembly includes an outer locking ring comprising the tapered inner surface. In this case, the outer locking ring preferably is a removable element which can be arranged during assembling on the shaft together with the cutter device. The tapered outer surface engaging the tapered inner surface on the outer locking ring can be formed on an outer surface preferably on the end of the shaft extending from the machine where the cutter device is to be placed.

According to a further preferred embodiment, the cutter device and the shaft contact each other in sections at a butt joint. Preferably, the cutter device and the shaft contact each other in sections at a butt joint in the area of or around the first locking device. This contact in the form of a butt joint is particularly preferred to transfer axial loads between the cutter device and the shaft in a direction bringing the cutter device and the shaft into contact, which can also be referred to as pushing force. Therefore, the butt joint can be provided to accommodate such pushing forces in addition to or instead of other means to transfer axial loads. For example, the fastening elements for fastening the cutter device to the shaft of the first locking device can be designed to transfer a certain amount of axial loads, in particular axial loads in a direction pulling the cutter device away from the undercutting machine (pulling forces). Typically, in an undercutting machine for cutting a rock workface, pushing forces as axial loads occurring during normal use on the cutter device will be much higher than pulling forces occurring during normal use. Therefore, it can be particularly preferred to provide fastening elements designed for safely and reliably transferring the pulling forces in axial direction occurring during normal use and to provide for a butt joint for transferring higher axial loads in the direction of pushing forces occurring during normal operating conditions.

According to a further preferred embodiment, a sealing carrier is releasably arranged on the shaft for carrying at least a part of a sealing arrangement. Preferably, the sealing carrier can be removed from the shaft in order to exchange the sealing arrangement or parts thereof and/or to exchange or overhaul the sealing carrier. Preferably, the sealing carrier can be removed when the cutter device is removed but cannot be removed as long as the cutter device is mounted on the shaft.

Further preferably, the sealing carrier is fixed rotationally rigid to the shaft and/or the cutter device. The sealing carrier preferably is mounted on the shaft and/or the cutter device in a torsion proof way, which means that a rotation of a shaft and/or the cutter device also leads to a corresponding rotation of the sealing carrier. Preferably, this rotationally rigid mounting of the sealing carrier on the shaft and/or the cutter device is realized by suitable mounting elements, for example by pins, bolts, or the like. Preferably, a plurality of such mounting elements is arranged equidistant in a circumferential manner. Further preferably, the sealing carrier is sealed against the shaft. In particular, the sealing carrier can be sealed against the shaft by a sealing element, like an o-ring.

In a further preferred embodiment, the cutter device is a cantilevered cutter ring. The cantilevered cutter ring preferably has an outer radial end and an inner radial end and further preferably an outer axial end face adjacent the outer radial end and an inner axial end face or inner axial contact face adjacent the inner radial end, wherein the outer axial end face and the inner axial end face preferably are parallel to each other. The diameter of the outer radial end preferably is larger than the diameter of the inner radial end.

According to a further combinable aspect, a cutter module comprises two or more cutter assemblies as described herein.

According to a further combinable aspect, a method of assembling a cutter assembly for an undercutting machine for cutting a rock workface, preferably a cutter assembly as described herein, is provided, wherein the method preferably comprises:

- providing a shaft mountable on the machine with one end extending from the machine and a cutter device,
- connecting the cutter device releasably and rotationally rigid to the shaft with a locking arrangement by
- applying an initial tension to the second locking device,
- applying an initial tension to the first locking device;
- applying a target tension to the second locking device,
- applying a target tension to the first locking device.

As to the advantages, preferred embodiments and details of the method and its preferred embodiments, reference is made to the corresponding aspects and embodiments of the cutter assembly described above.

In addition, some explanations with respect to the method are given below, which in turn can also serve as a reference regarding advantages, preferred embodiments and details of the cutter assembly as described above, where applicable.

Preferably, the method of assembling a cutter assembly comprises the steps mentioned above, wherein the steps of connecting the cutter device releasably and rotationally rigid to the shaft with a locking arrangement are conducted in the order mentioned above, namely firstly, applying an initial tension to the second locking device, secondly, applying an initial tension to the first locking device, thirdly, applying a target tension to the second locking device, and finally applying a target tension to the first locking device.

By complying with this order of applying initial and target tensions to the first and second locking devices, it can be assured that firstly, the cutter device is properly centred on the shaft and then the cutter device is put into place for the transfer of axial loads by applying the initial tension to the first locking device before the final target tension is applied to both locking devices. Further, by first applying the target tension to the second locking device, it can be assured that also when the target tension is applied, the cutter device will be properly centred on the shaft and will not be distorted.

Preferably, before the initial tension is applied to the second locking device, the second locking device and the cutter device are arranged on the shaft. Further preferably, the initial tension is applied to the first locking device, the first locking device is arranged in place.

Herein, an initial tension is to be understood as a tension of less than 50% of the target tension. Further, the target tension herein is to be understood as the maximum tension which is to be applied to the first and second locking devices, respectively under normal operating conditions. In case the first and/or second locking devices comprise threaded bolt engaging mating threaded bores, for example, the initial tension and the target tension may be torques. Further, the initial tension and the target tension of the first locking device may differ from the initial tension and the target tension from the second locking device.

BRIEF DESCRIPTION OF THE DRAWINGS

Preferred embodiments of the invention shall now be described with reference to the attached drawings, in which.

DETAILED DESCRIPTION

Figure 1:
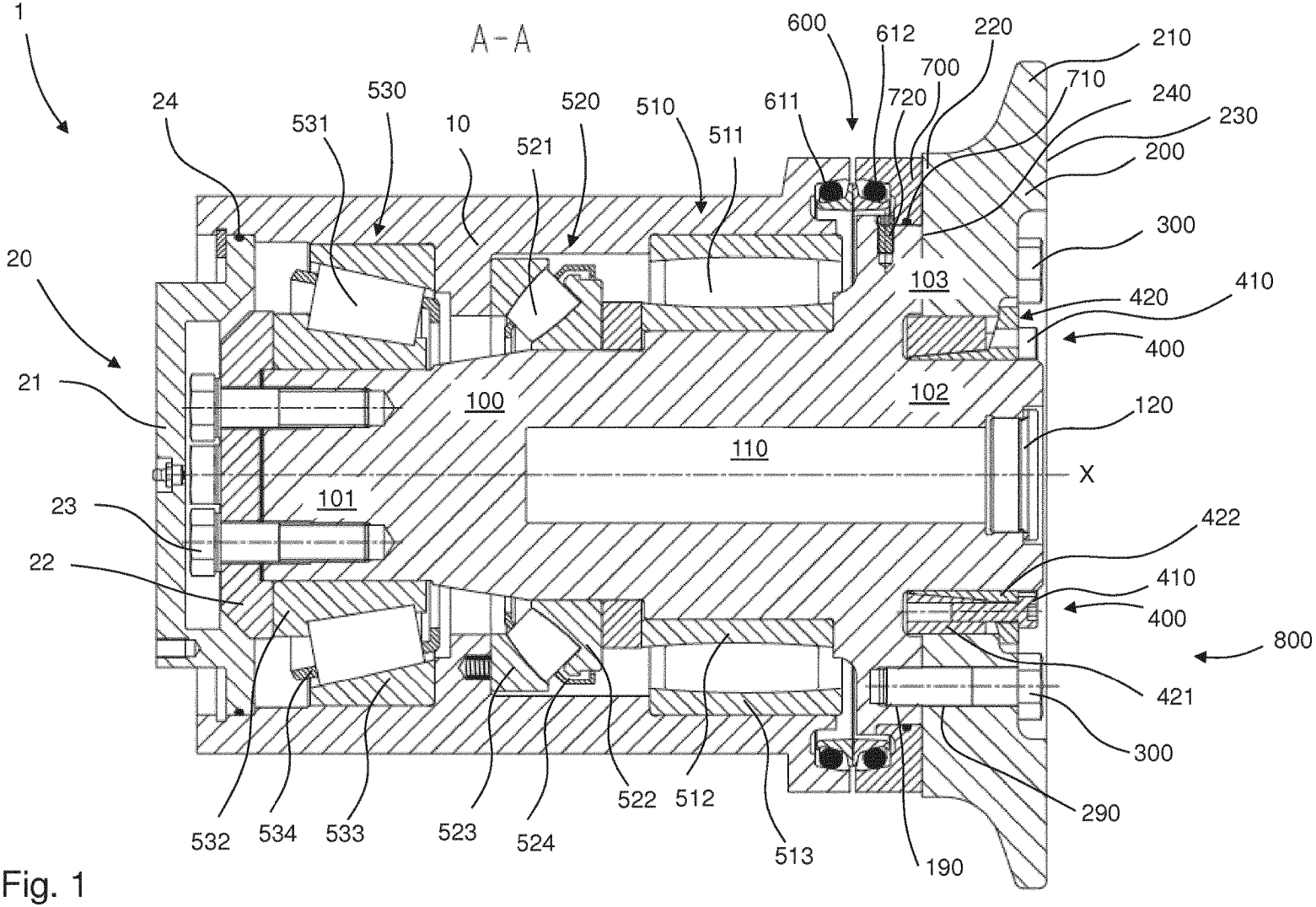
FIG. 1: shows a longitudinal section of an exemplary embodiment of a cutter assembly along section A-A as indicated in FIG. 2.
Figure 2:
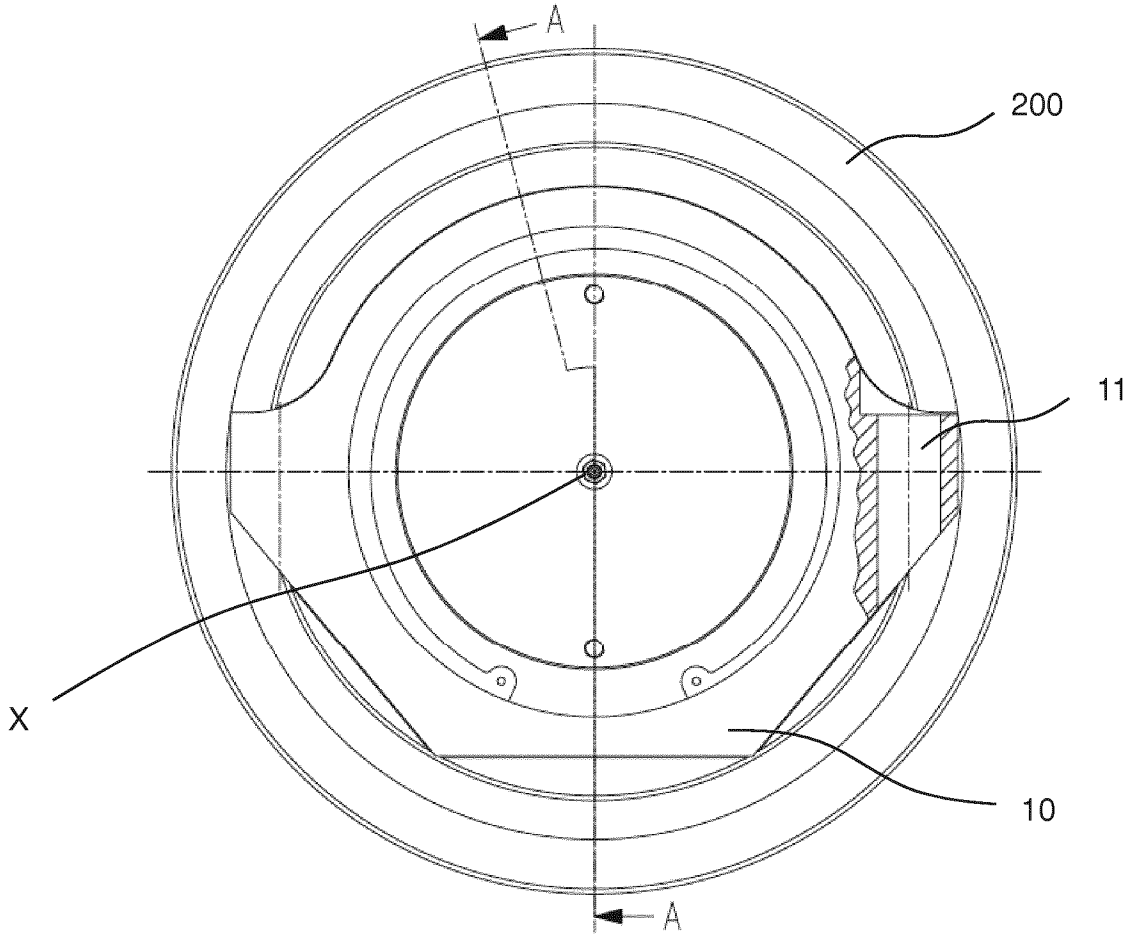
FIG. 2: shows a cross section of the cutter assembly according to FIG. 1.
Figure 3:
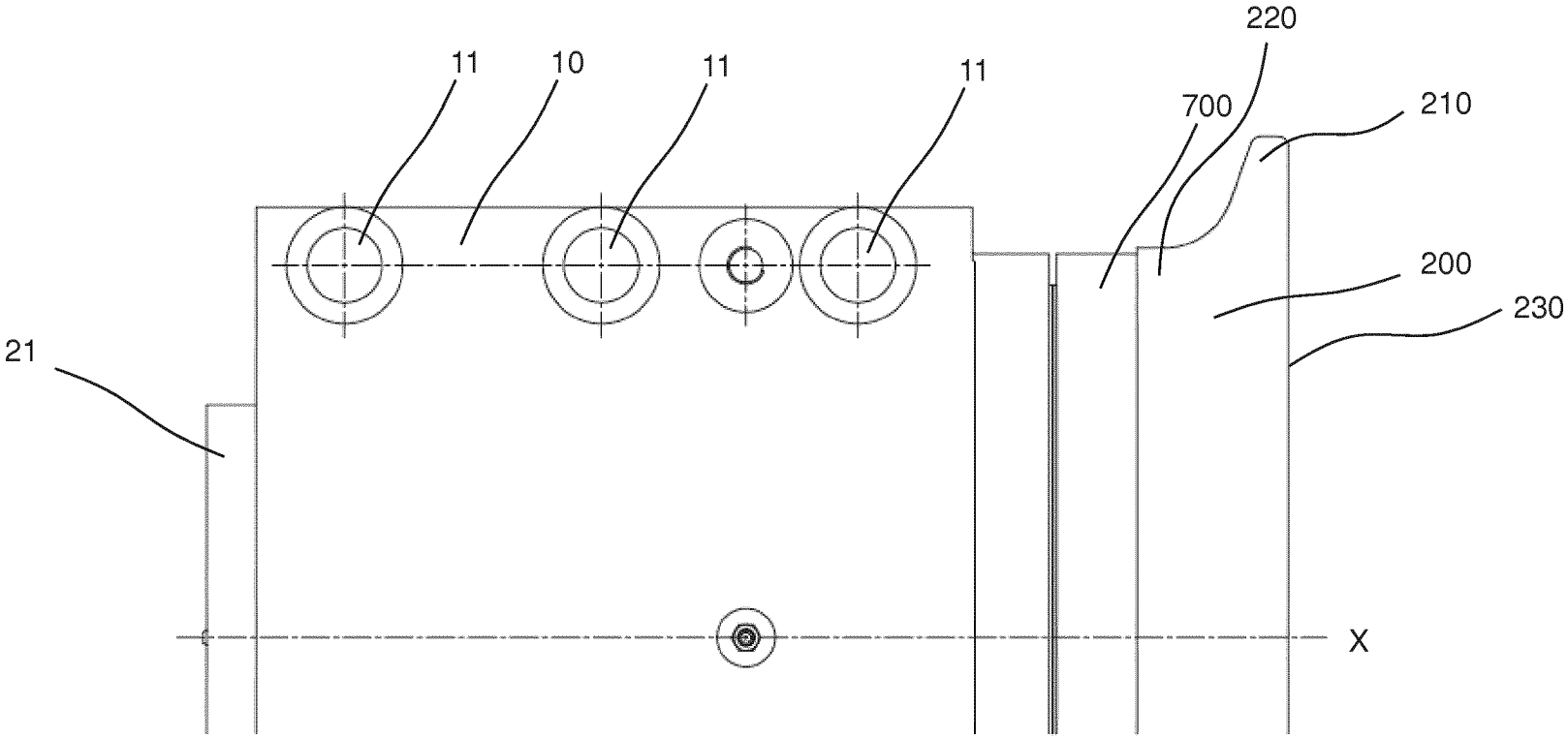
FIG. 3: shows a part of a top view of the cutter assembly according to FIG. 1.

FIGS. 1 to 4 show an exemplary embodiment of a cutter assembly 1 for an undercutting machine for cutting a rock workface comprising a shaft 100 and a shaft supporting structure 10 in the form of a housing. The shaft 100 is at least partly arranged within the shaft supporting structure 10 and has an extended end 102 extending from the machine provided with a cutter device 200 and a rear end 101 for mounting the shaft 100 to the machine. Rear end 101 of the shaft 100 is provided with a pretensioning washer 22 which is connected to the rear end 101 of the shaft 100 via pretensioning bolts 23. At the rear end 20 of the cutter assembly 1, a rear cover 21 is sealingly, via o-ring seal 24, connected to the shaft supporting structure 10 covering the rear end 101 of the shaft 100 with the pretensioning washer 22. The shaft supporting structure 10 comprises several bores 11 for connecting the shaft supporting structure to an undercutting machine for cutting a rock workface.

The shaft 100 has a central hollow interior 110 and a longitudinal axis X or axial direction. The central hollow interior 110 is covered by an end element 120. Between the shaft 100 and the shaft supporting structure 10, a first rolling element 510 is arranged in a floating or slidable manner in the axial direction. Further, a second rolling element 520 is arranged between the shaft supporting structure 10 and the shaft 100. Further, an optional, but preferred third rolling element 530 is arranged between the shaft supporting structure 10 and the shaft 100. The second rolling element 520 is arranged further distant from the cutter device 200 in the axial direction or along the longitudinal axis X of the shaft 100 than the first rolling element 510. The third rolling element 530 is arranged further distant from the cutter device 200 in the axial direction or along the longitudinal axis X of the shaft 100 than the first rolling element 510 and the second rolling element 520.

In the exemplary embodiment shown herein, the first rolling element 510 is a toroidal roller bearing, the second rolling element 520 is a spherical thrust bearing and the third rolling element 530 is a tapered roller bearing. The first rolling element 510 comprises first rollers 511 surrounded by inner and outer ring race ways 512, 513. The second rolling element 520 comprises second rollers 521, shaft and housing washers 522, 523, and cage 524. The third rolling element 530 comprises third rollers 531, inner and outer rings 532, 533, and cage 534.

At the extended end 102 of the shaft 100, the cutter device 200 is connected releasably and rotationally rigid to the shaft 100 with a locking arrangement 800. The locking arrangement 800 comprises a first locking device 300 arranged and adapted to transfer substantially axial loads and a second locking device 400 arranged and adapted to transfer substantially radial loads. The first and the second locking devices 300, 400 are radially spaced apart from each other, wherein the first locking device 300 is located radially outwardly from the second locking device 400.

The first locking device 300 comprises a plurality of fastening elements for fastening the cutter device 200 to the shaft 100. In the present example, the fastening elements are fastening bolts extending through mating bores 290 in the cutter device 200 and extending into dead bores 190 in the shaft 100. The fastening elements may be threaded bolts and engage mating threads in the bores 290 and 190 in the cutter device 200 and the shaft 100. Preferably, the fastening elements are arranged equidistant in a circumferential manner.

Further, the cutter device 200 and the shaft 100 contact each other in sections at a butt joint 103 in the area of or around the first locking device 300. In particular, an inner axial end face or inner axial contact face 240 of the cutter device 200 contacts a corresponding contact face on the shaft 100 for creating the butt joint 103. This butt joint provides an effective way for transferring axial loads in a pushing direction from the cutter device 200 to the shaft 100. This can be advantageous to increase the capacity to transfer axial loads in the direction of pushing forces in addition to the capacity to transfer axial loads in both axial direction (pushing and pulling forces) provided by the fastening elements in the form of threaded bolts, for example. This is particularly advantageous, since during usual operating conditions of cutter assemblies for undercutting machines for cutting rock work faces, the pushing forces that need to be transferred from the cutter device 200 to the shaft 100 usually are considerably higher than pulling forces that need to be transferred in the opposite direction. Therefore, by providing a butt joint 103 in addition to fastening elements at the first locking device 300, an efficient axial load transfer can be provided.

Further, by being adapted and arranged to transfer axial loads in opposite directions, the first locking device 300 is also arranged and adapted to transfer bending moments, since, in particular due to the relatively larger diameter of the first locking device 300 compared to the second locking device 400, occurring bending moments can be split into positive and negative axial forces occurring on two opposite fastening elements.

The second locking device 400 comprises in the example shown in FIGS. 1 to 4 a tapered locking assembly 420 including a plurality of fixing elements 410 for fixing a tapered outer surface and a tapered inner surface relative to each other. In the example of a tapered locking assembly 420 shown herein, the tapered locking assembly 420 includes an inner locking ring 422 comprising the tapered outer surface and an outer locking ring 421 comprising the tapered inner surface. However, in an alternative embodiment, the tapered inner surface could be formed on the cutter device 200, in which case an outer locking ring would not need to be provided. With the plurality of fixing elements 410, which are preferably arranged equidistant in a circumferential manner, the inner and outer tapered surfaces can be fixed relative to each other, thereby centring the cutter device 200 on the shaft 100. Further, the tapered locking assembly 420 is efficient in transferring radial loads between the cutter device 200 and the shaft 100.

This locking arrangement 800 with the first and second locking devices 300 and 400 has the advantage that the cutter device 200 can be removed in a substantially non-destructive way and overhauled and reinstalled or replaced by a new cutter device, without having to bring the whole cutter assembly 1 to a workshop, but rather leave the cutter assembly 1 installed on the undercutting machine and exchange only the cutter device 200 in situ.

When exchanging the cutter device 200, in particular installing the cutter device 200 on the shaft 100, it is preferred to arrange the second locking device 400 and the cutter device 200 on the shaft and to arrange the first locking device 300 in place. In particular, it is preferred that the following steps are carried out in the following order: Firstly, applying an initial tension to the second locking device, which preferably is less than 50% of a target tension of the second locking device; secondly, applying an initial tension to the first locking device, which is preferably less than 50% of a target tension of the first locking device; thirdly, applying the target tension to the second locking device; and lastly, applying the target tension to the first locking device. The target tension of the first and second locking device (and correspondingly, the initial tension of the first and second locking device) may differ and depend on the kind of locking devices employed as first and second locking devices and, in particular, the kind of fixing or fastening elements employed in the first and second locking devices.

By installing the cutter device on the shaft in this manner, it can be assured that the second locking device 400 properly centres the cutter device 200 on the shaft 100 while at the same time the connection at the first locking device is put in place properly for a correct transfer of axial loads.

The bearing arrangement with the first, second and third rolling elements 510, 520, 530 has been designed to allow for clearer defined load cases for each rolling element than in the prior art, and allows to design and dimension the bearings more precisely, resulting in a higher bearing lifetime. The first rolling element 510 is floating or slidable in an axial direction, such that the first rolling element 510 substantially transfers radial loads. Axial loads are transferred primarily by the second and third rolling elements 520, 530.

The third rolling element 530 and the second rolling element 520 are adapted and arranged such that an inclination direction of the contact angle and/or the rotation axes of the second rollers 521 of the second rolling element 520 is different from an inclination direction of a contact angle and/or rotation axes of third rollers 531 of the third rolling element 530. In this way, the third rolling element 530 primarily serves to take axial forces in a direction opposite to the forces which are taken primarily by the second rolling element 520. In addition, the third rolling element 530 serves to pretension or bias the second rolling element 520.

Figure 4:
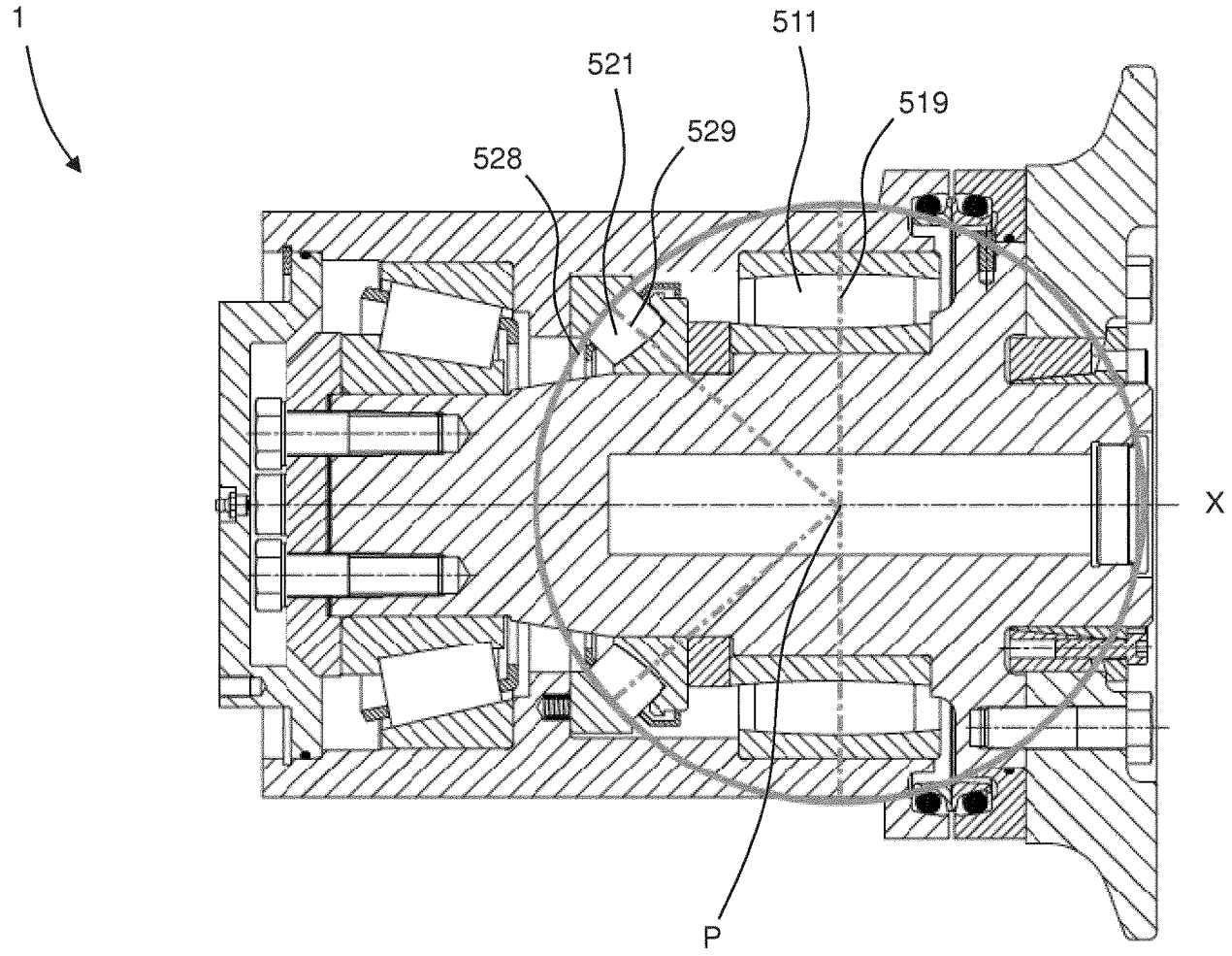
FIG. 4: shows a longitudinal section of the cutter assembly with an indication of the centre plane of the first rolling element and the centre of the sphere formed by outer surfaces of second rollers of the second rolling element.

In order to achieve that the second rolling element 520 primarily serves to take axial loads and to ensure that the radial loads are primarily taken by the first rolling element 510, a line orthogonal to an outer surface of a second roller 521 of the second rolling element 520 crosses the longitudinal axis X of the shaft 100 at a centre plane 519 of the first rolling element 510, as can be seen in FIG. 4. In particular, since the second rolling element 520 is a spherical thrust bearing, in the longitudinal section the outer surfaces of the second rollers 521 form a (virtual) sphere 528 with a (virtual) centre P. In the example shown herein, this (virtual) centre P of the (virtual) sphere 528 formed by the outer surfaces of the second rollers 521 of the second rolling element 520 lies on the longitudinal axis X and within the (virtual) centre plane 519 of the first rolling element 510, as can be seen in FIG. 4. Alternatively, good results are also achieved in case the centre P of the sphere 528 lies within a range of +/−25% or less, as described above, of the axial extension of the first rolling element 510, in particular its first rollers 511, from that centre plane. In other words, the centre P of the sphere 528 may deviate from the centre plane 519 along the longitudinal axis X of the shaft 100 to some extent within the range mentioned above.

Preferably, all three rolling elements 510, 520, 530 remain installed in their positions between the shaft supporting structure 10 and the shaft during disassembly of the cutter assembly, for example during removal and/or reinstallation of the cutter device and/or the sealing arrangement and/or the sealing carrier.

The cutter device 200 in the embodiment shown herein is a cutter ring, but may also have the shape of a cutter disc, for example. Preferably, the cutter device is a cantilevered cutter ring. As shown in the embodiment in the Figures, the cutter device 200 has an outer radial end 210 and an inner radial end 220, wherein the radius of the outer radial end 210 is larger than the radius of the inner radial end 220. Adjacent to the outer radial end is an outer axial end face 230 and adjacent to the inner radial end 220 is an inner axial end face or inner axial contact face 240. Preferably, the outer axial end face 230 and the inner axial end face 240 are parallel to each other.

The cutter assembly 1 further comprises a sealing carrier 700, which is fixed rotationally rigid to the shaft 100. In the embodiment shown herein, the sealing carrier 700 is ring-shaped and fixed rotationally rigid to the shaft 100 by pins 720 and is sealed against the shaft 100 by an o-ring seal 710. The sealing carrier 700 serves to carry at least a part of a sealing arrangement 600. The sealing arrangement 600 in the embodiment shown herein comprises two o-ring seals 611, 612 sealing the shaft supporting structure 10 and the sealing carrier 700 against the shaft 100. By arranging the sealing carrier 700 releasably on the shaft it is possible to disassemble, in particular service, for example exchange or overhaul, the sealing arrangement 600 or parts thereof easily and in a non-destructive manner. In the embodiment shown herein, it is necessary to first remove the cutter ring 200, before the sealing carrier 700 can be removed.

In FIGS. 1 to 4, a preferred example of cutter assembly with a releasable cutter ring 200 connected via a locking device 800 and with a special bearing arrangement with a first and second rolling element 510, 520 and a preferred, but optional rolling element 530, is shown. Although in the Figures, these aspects are shown in combination, the different aspects described herein also can be applied separately.

The invention claimed is:

1. A cutter assembly for an undercutting machine for cutting a rock workface, the cutter assembly comprising:

a shaft supporting structure;

a shaft at least partly arranged within the shaft supporting structure;

a cutter device arranged on the shaft or the shaft supporting structure, wherein the cutter device is detachably, but rotationally rigidly mounted on the shaft via a locking arrangement;

a first rolling element arranged between the shaft supporting structure and the shaft in a floating or slidable manner in an axial direction; and a second rolling element arranged between the shaft supporting structure and the shaft, wherein a line orthogonal to an outer surface of the second rolling element crosses a longitudinal axis of the shaft at a centre plane of the first rolling element or within a range of +/−25% of an axial extension of the first rolling element from said centre plane.

2. The cutter assembly according to claim 1, wherein the second rolling element is arranged at a further distant from the cutter device in an axial direction of the shaft than the first rolling element.

3. The cutter assembly according to claim 1, wherein the cutter device is a cantilevered cutter ring.

4. The cutter assembly according to claim 1, further comprising a third rolling element arranged between the shaft supporting structure and the shaft.

5. The cutter assembly according to claim 4, wherein the third rolling element is arranged at a further distant from the cutter device in an axial direction of the shaft than the first rolling element and the second rolling element.

6. The cutter assembly according to claim 4, wherein the third rolling element and the second rolling element are arranged such that an inclination direction of a contact angle and/or rotation axes of the second rolling element is different from an inclination direction of a contact angle and/or rotation axes of the third rolling element.

7. The cutter assembly according to claim 4, wherein the third rolling element is a tapered roller bearing.

8. The cutter assembly according to claim 1, wherein a centre of a sphere formed by outer surfaces of the second rolling element lies within the centre plane of the first rolling element or within a range of +/−25% of an axial extension of the first rolling element from said centre plane.

9. The cutter assembly according to claim 1, wherein the second rolling element is a spherical thrust bearing.

10. The cutter assembly according to claim 1, wherein the first rolling element is a spherical or toroidal roller bearing.

11. A cutter module comprising two or more cutter assemblies as claimed in claim 1.

12. A method of disassembling a cutter assembly for an undercutting machine for cutting a rock workface, the method comprising:

providing a cutter assembly for an undercutting machine for cutting a rock workface, the cutter assembly including a shaft supporting structure, a shaft at least partly arranged within the shaft supporting structure, a cutter device arranged on the shaft or the shaft supporting structure, wherein the cutter device is detachably but rotationally rigidly mounted on the shaft via a locking arrangement; a first rolling element arranged between the shaft supporting structure and the shaft in a floating or slidable manner in an axial direction, and a second rolling element arranged between the shaft supporting structure and the shaft, wherein a line orthogonal to an outer surface of the second rolling element crosses a longitudinal axis of the shaft at a center plane of the first rolling element or within a range of +/−25% of an axial extension of the first rolling element from the center plane;

removing the cutter device and/or a rear cover arranged on the shaft and/or the shaft supporting structure; and reinstalling the cutter device and/or the rear cover or installing a new cutter device and/or a new rear cover, wherein the first and second rolling elements remain installed in the positions between the shaft supporting structure and the shaft during the disassembling of the cutter assembly.

13. The method according to claim 12, further comprising a third rolling element arranged between the shaft supporting structure and the shaft, wherein the third rolling element remains installed in its position between the shaft supporting structure and the shaft during the disassembling of the cutter assembly.

* * * * *